US005278913A

United States Patent [19]

Delfosse et al.

[11] Patent Number: 5,278,913

[45] Date of Patent: Jan. 11, 1994

[54] ACTIVE ACOUSTIC ATTENUATION SYSTEM WITH POWER LIMITING

[75] Inventors: Kent F. Delfosse; Shawn K. Steenhagen, both of Madison, Wis.

[73] Assignee: Nelson Industries, Inc., Stoughton, Wis.

[21] Appl. No.: 920,774

[22] Filed: Jul. 28, 1992

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | |
|---|---|---|
| 4,473,906 | 9/1984 | Warnaka et al. . |
| 4,677,676 | 6/1987 | Eriksson . |
| 4,677,677 | 6/1987 | Eriksson . |
| 4,736,431 | 4/1988 | Allie et al. . |
| 4,815,139 | 3/1989 | Eriksson et al. . |
| 4,837,834 | 6/1989 | Allie . |
| 4,987,598 | 1/1991 | Eriksson . |
| 5,022,082 | 6/1991 | Eriksson et al. . |
| 5,033,082 | 6/1991 | Eriksson et al. . |

OTHER PUBLICATIONS

"Active Adaptive Sound Control In A Duct: A Computer Simulation", J. S. Burgess, Journal of Acoustic Society of America, 70(3), Sep., 1981, pp. 715-726.

"Number Theory In Science and Communications", Berlin: Springer-Verlag, M. R. Schroeder, 1984, pp. 252-261.

"Adaptive Filters: Structures, Algorithms, and Applications", Honig et al The Kluwer International Series in Engineering and Computer Science, VLSI, Computer Architecture and Digital Signal Processing, 1984.

*Primary Examiner*—Forester W. Isen

*Attorney, Agent, or Firm*—Andrus, Sceales, Starke & Sawall

[57] ABSTRACT

An active acoustic attenuation system prevents overdriving of the canceling output transducer or speaker (14) by shunting at least part of the correction signal (46) to a parallel shunt path (306) and away from the output transducer (14) Variable gains (308 and 310) are provided in the shunt path (306) and the input to the output transducer (14) for varying the ratio between the part of the correction signal (46) supplied to the output transducer (14) and the part of the correction signal (46) shunted to the shunt path (306). A first adaptive filter model (40) has an error input (202) from the error signal and outputs the correction signal (46). A second adaptive filter model (142) models the output transducer (14) and the error path (56) between the output transducer (14) and the error transducer (16). A copy (312) of the second model (142) has an input from the output (46) of the first model (40), and the output of the copy (312) is summed with the error signal (44) and the resultant sum is supplied to the error input (202) of the first model (40), such that the shunt path (306) is provided through the model copy (312).

29 Claims, 2 Drawing Sheets

ACTIVE ACOUSTIC ATTENUATION SYSTEM WITH POWER LIMITING

BACKGROUND AND SUMMARY

The invention relates to active acoustic attenuation systems, and provides a system for limiting output power of the correction signal to the canceling output transducer.

The invention arose during continuing development efforts relating to the subject matter shown and described in U.S. Pat. Nos. 4,677,676, 4,677,677, 4,736,431, 4,815,139, 4,837,834, 4,987,598, 5,022,082, and 5,033,082, incorporated herein by reference.

Active attenuation involves injecting a canceling acoustic wave to destructively interfere with and cancel an input acoustic wave. In an active acoustic attenuation system, the output acoustic wave is sensed with an error transducer such as a microphone which supplies an error signal to a control model which in turn supplies a correction signal to a canceling output transducer such as a loudspeaker which injects an acoustic wave to destructively interfere with and cancel the input acoustic wave. The acoustic system is modeled with an adaptive filter model.

In some applications, the acoustic pressure level of the input acoustic wave may exceed the ability of the canceling output transducer to cancel same. An example is a sudden change in the input noise level, for instance sudden engine acceleration in automotive exhaust silencing applications. During this condition, the active noise controller may become unstable if it is allowed to adapt and output a correction signal which is beyond the capability of the canceling loudspeaker or otherwise attempt to overdrive same. When the input noise decreases to normal levels, e.g. upon termination of the sudden acceleration, the control model will have to re-adapt and converge new weight update coefficients.

In one aspect of the present invention, overdriving of the canceling output transducer is prevented by engaging a power limiting function which is accomplished by shunting at least part of the correction signal to a shunt path and away from the output transducer. The shunt path is in parallel with the output transducer and when engaged at high input noise levels enables the adaptive filter model to remain stable and converged, with part of the correction signal still going to the canceling output transducer and the remainder of the correction signal going through the shunt path around the output transducer, while the adaptive filter model continues to adapt.

In another aspect, variable gains are provided in one or both of the shunt path and the input to the output transducer. The ratio between the part of the correction signal supplied to the output transducer and the part of the correction signal shunted to the shunt path is varied.

In another aspect, a second adaptive filter model is provided and models the output transducer and the error path, and the shunt path is provided through a copy of such second model.

In another aspect, the power limiter is engaged when the part of the correction signal supplied to the output transducer exceeds an engagement threshold, and is disengaged when a calculated correction signal, theoretically needed for full cancellation, decreases below a disengagement threshold. If the part of the correction signal supplied to the output transducer is greater than a given range, then the part of the correction signal supplied to the output transducer is decreased and the part of the correction signal shunted to the shunt path is increased. If the theoretically needed correction signal is less than another given range, then the part of the correction signal supplied to the output transducer is increased and the part of the correction signal shunted to the shunt path is decreased.

BRIEF DESCRIPTION OF THE DRAWINGS

Prior Art

Present Invention

Figure 2:
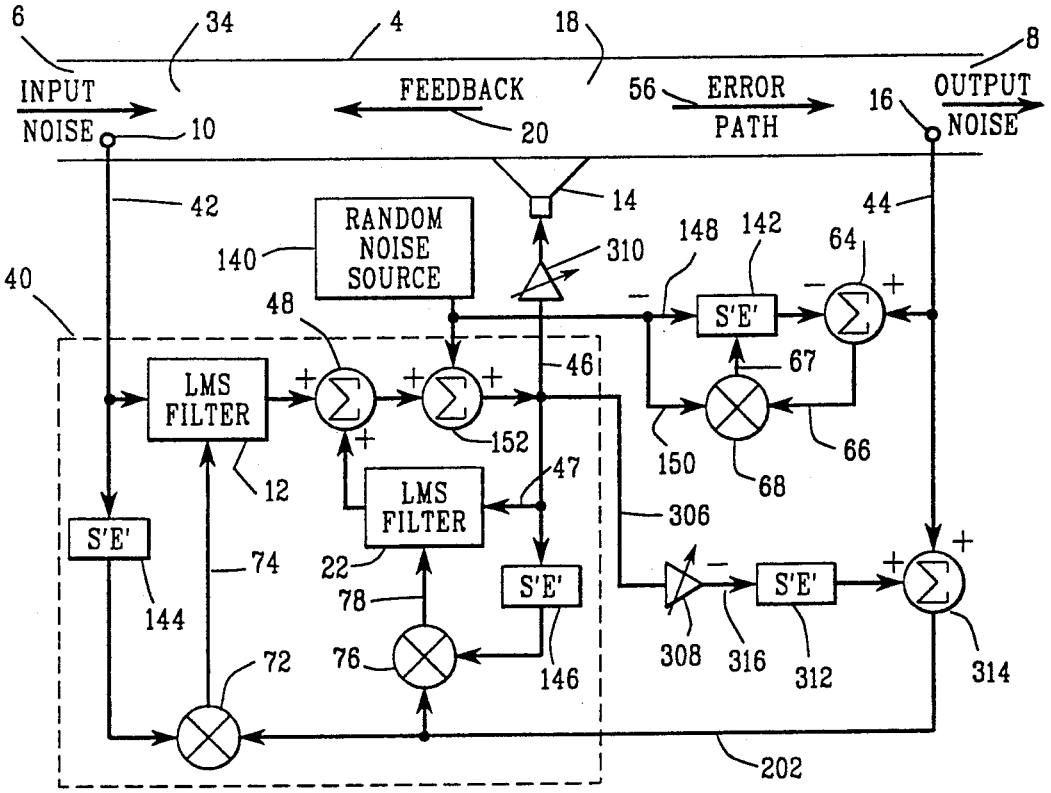

FIG. 2 illustrates an active acoustic attenuation system in accordance with the present invention.

Figure 3:
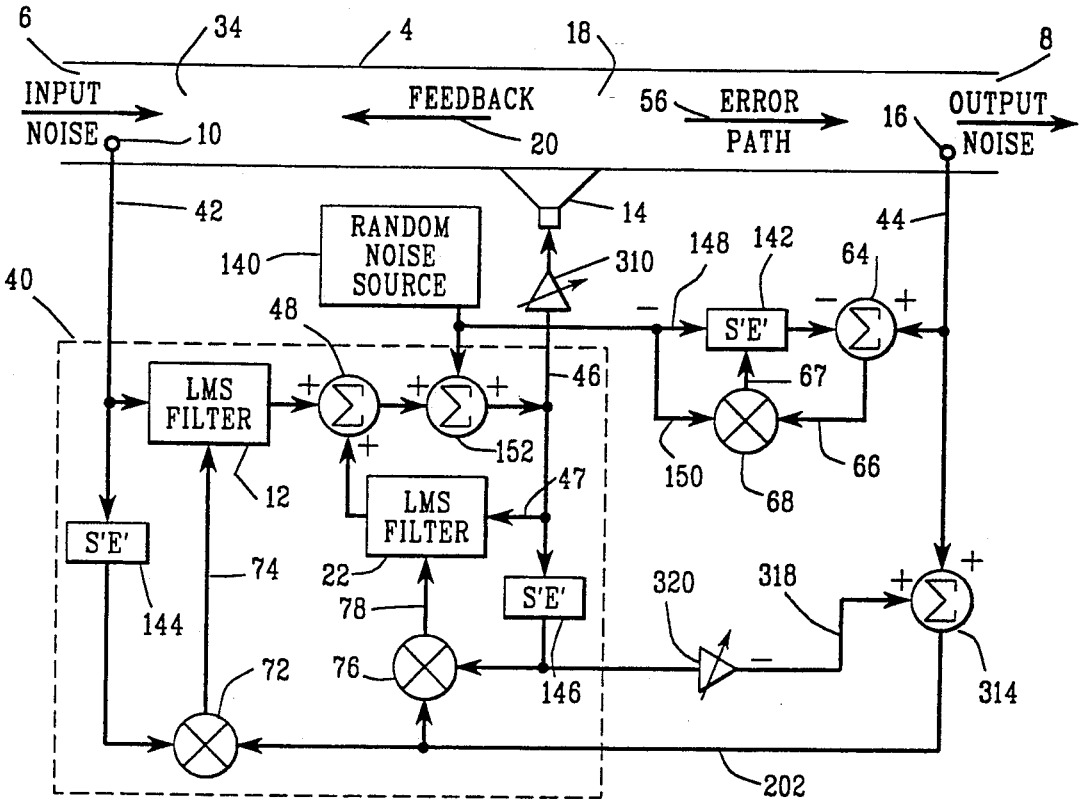

FIG. 3 is like FIG. 2 and shows a further embodiment.

DETAILED DESCRIPTION

Prior Art

Figure 1:
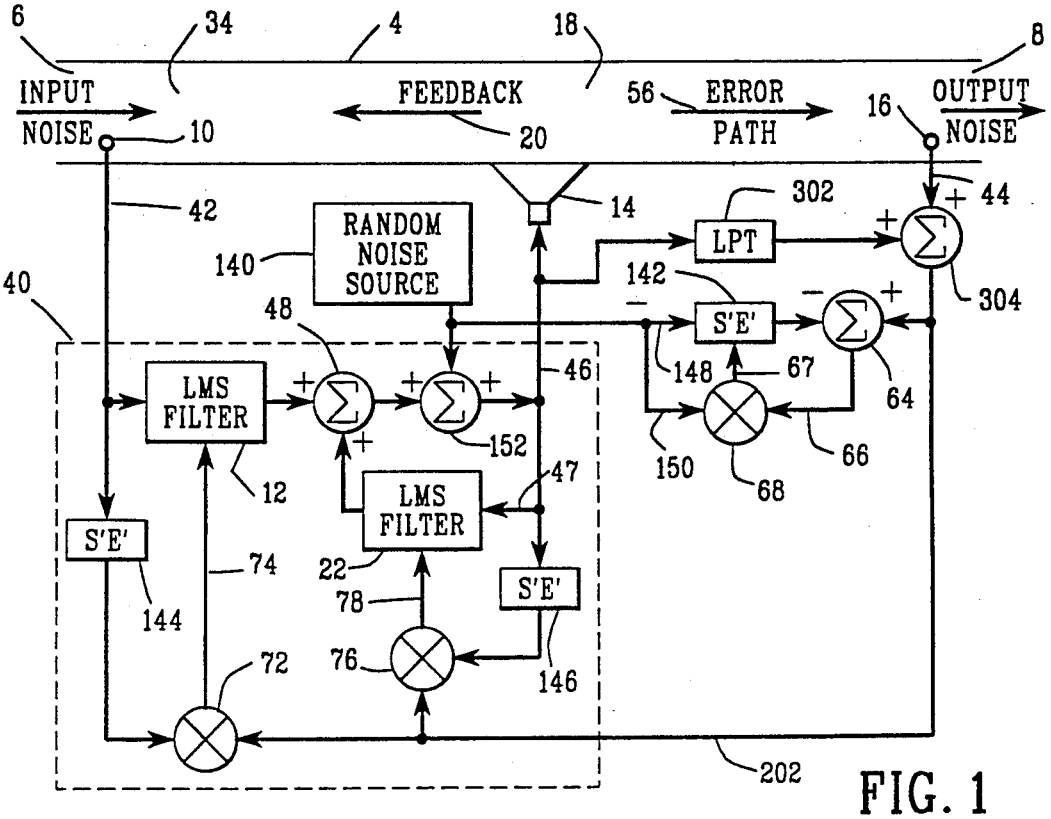
FIG. 1 PRIOR ART
FIG. 1 illustrates an active acoustic attenuation system known in the prior art.

FIG. 1 shows an active acoustic attenuation system similar to that shown in FIG. 19 of incorporated U.S. Pat. No. 4,677,676, and uses like reference numerals therefrom where appropriate to facilitate understanding.

The acoustic system in FIG. 1 has an input 6 for receiving an input acoustic wave along a propagation path or environment such as a duct or plant 4, and has an output 8 for radiating an output acoustic wave. The active acoustic attenuation method and apparatus introduces a canceling acoustic wave from an output transducer 14, such as a loudspeaker. The input acoustic wave is sensed with an input transducer 10, such as a microphone. The output acoustic wave is sensed with an error transducer 16, such as a microphone, providing an error signal 44. The acoustic system is modeled with an adaptive filter model 40 having a model input 42 from input transducer 10 and an error input 202 from error signal 44, and outputting a correction signal 46 to output transducer 14 to introduce the canceling acoustic wave. Model 40 is provided by least-mean-square, LMS, filters 12 and 22, all as in the incorporated '676 patent. The system compensates for feedback along feedback path 20 to input 6 from transducer 14 for both broadband and narrowband acoustic waves, on-line without off-line pre-training, and providing adaptive modeling and compensation of error path 56 and adaptive modeling and compensation of output transducer 14, all on-line without off-line pre-training, as in the incorporated '676 patent.

An auxiliary noise source 140 introduces noise into the output of model 40. The auxiliary noise source is random and uncorrelated to the input noise at 6, and in preferred form is provided by a Galois sequence, M. R. Schroeder, Number Theory in Science and Communications, Berlin: Springer-Verlag, 1984, pp. 252–261, though other random uncorrelated noise sources may be used. The Galois sequence is a pseudorandom sequence that repeats after $2^M-1$ points where M is the number of stages in a shift register. The Galois sequence is preferred because it is easy to calculate and can easily have a period much longer than the response time of the system.

Model 142 models both the error path E 56 and the output transducer or speaker S 14 on-line. Model 142 is a second adaptive filter model provided by a LMS filter. A copy S'E' of the model is provided at 144 and 146 in model 40 to compensate for speaker S 14 and error path E 56. Second adaptive filter model 142 has a model input 148 from auxiliary noise source 140. The error signal output 44 of error path 56 at error transducer 16 is summed at summer 304 with the output of low-pass-through, LPT, filter 302, to be described, and the result is added to the output of model 142 and the result is used as an error input at 66 to model 142. The sum at 66 is multiplied at multiplier 68 with the auxiliary noise at 150 from auxiliary noise source 140, and the result is used as a weight update signal at 67 to model 142.

The outputs of the auxiliary noise source 140 and model 40 are summed at 152 and the result is used as the correction signal 46 supplied to output transducer 14. Adaptive filter model 40, as noted above, is provided by first and second LMS algorithm filters 12 and 22 each having an error input 202 from the output resultant sum from summer 304 comprised of the sum of the output of LPT filter 302 and error signal 44 from error transducer 16. The outputs of first and second LMS algorithm filters 12 and 22 are summed at summer 48 and the resulting sum is summed at summer 152 with the auxiliary noise from auxiliary noise source 140 and the resulting sum is correction signal 46. An input at 42 to algorithm filter 12 is provided from input transducer 10. Input 42 also provides an input to model copy 144. The output of copy 144 is multiplied at multiplier 72 with the error signal and the result is provided as weight update signal 74 to algorithm filter 12. The correction signal at 46 provides an input 47 to algorithm filter 22 and also provides an input to model copy 146. The output of copy 146 and the error signal are multiplied at multiplier 76 and the result is provided as weight update signal 78 to algorithm filter 22.

Auxiliary noise source 140 is an uncorrelated low amplitude noise source for modeling speaker S 14 and error path E 56. This noise source is in addition to the input noise source at 6 and is uncorrelated thereto, to enable the S'E' model to ignore signals from the main model 40 and from plant 4. Low amplitude is desired so as to minimally affect final residual acoustical noise radiated by the system. The second or auxiliary noise from source 140 is the only input to the S'E' model 142, and thus ensures that the S'E' model will correctly characterize SE. The S'E' model is a direct model of SE, and this ensures that the RLMS model 40 output and the plant 4 output will not affect the final converged model S'E' weights. A delayed adaptive inverse model would not have this feature. The RLMS model 40 output and plant 4 output would pass into the SE model and would affect the weights.

The auxiliary noise signal from source 140 is summed at junction 152 after summer 48 to ensure the presence of noise in the acoustic feedback path and in the recursive loop. The system does not require any phase compensation filter for the error signal because there is no inverse modeling. The amplitude of noise source 140 may be reduced proportionate to the magnitude of error signal 66, and the convergence factor for error signal 44 may be reduced according to the magnitude of error signal 44, for enhanced long term stability, "Adaptive Filters Structures, Algorithms, And Applications", Michael L. Honig and David G. Messerschmitt, The Kluwer International Series in Engineering and Computer Science, VLSI, Computer Architecture And Digital Signal Processing, 1984.

A particularly desirable feature of the system is that it requires no calibration, no pre-training, no pre-setting of weights, and no start-up procedure. One merely turns on the system, and the system automatically compensates and attenuates undesirable output noise.

The low-pass-through, LPT, filter 302 provides an auxiliary path for correction signal 46 around output transducer 14 and error path 56 and in parallel therewith. LPT filter 302 provides such alternate path for low frequencies where attenuation is undesired or ineffective or there is a fall-off in speaker response, etc. The output of LPT filter 302 is summed with error signal 44 at summer 304 and the resultant sum is provided to error input 202. LPT filter 302 passes low frequencies therethrough but does not protect or prevent overdriving of output transducer 14 in response to excessive correction signals 46 or excessive input acoustic waves 6. The acoustic pressure level of the input acoustic wave may still exceed the ability of the canceling output transducer 14 to cancel same. During this condition, model 40 may become unstable if it is allowed to adapt and output a correction signal which is beyond the capability of output transducer 14 or otherwise attempt to overdrive same. When the input noise decreases to normal levels following the momentary increase in input noise level, model 40 will have to re-adapt and converge new weight update coefficients.

Present Invention

FIG. 2 uses like reference numerals from FIG. 1 where appropriate to facilitate understanding FIG. 2 shows an active acoustic attenuation system for attenuating an input acoustic wave. Output transducer 14 introduces a canceling acoustic wave to attenuate the input acoustic wave and yield an attenuated output acoustic wave at output 8. Error transducer 16 senses the output acoustic wave and provides an error signal 44. Adaptive filter model 40 models the acoustic system and has an error input 202 and outputs a correction signal 46 to output transducer 14 to introduce the canceling acoustic wave. A shunt path 306 is provided around output transducer 14 for power limiting. Overdriving of output transducer 14 is prevented by shunting at least part of correction signal 46 away from output transducer 14. Shunt path 306 is in parallel with output transducer 14 and error path 56. In the preferred embodiment, a variable gain is provided in at least one of the shunt path and the input to output transducer 14, and the ratio between the part of the correction signal supplied to output transducer 14 and the part of the correction signal shunted to shunt path 306 is varied. It is preferred that a variable gain 308, such as a variable amplifier, be provided in shunt path 306, and another variable gain 310, such as a variable amplifier, be provided in the input to output transducer 14. It is preferred that the sum of gains 308 and 310 be unity, such that the resultant sum at error input 202 remains unaffected by different ratios between gains 308 and 310. Another S'E' model copy 312 is provided in shunt path 306 and has an input from output correction signal 46 from model 40. The output of model copy 312 is summed with error signal 44 at summer 314 and the resultant sum is supplied to error input 202.

It is preferred that correction signal 46 be at least partially shunted from the input of output transducer 14 to the output of error transducer 16 in response to a given characteristic of correction signal 46 which would cause overdriving of output transducer 14. Alternatively, correction signal 46 can be shunted in response to a given characteristic of the input acoustic wave at input 6 which would cause model 40 to output a correction signal 46 which would cause overdriving of output transducer 14. Other criteria may be used as a condition for engaging the power limiting feature. In the fully engaged condition of the power limiter, gain 308 is one and gain 310 is zero, and all of correction signal 46 is shunted through path 306 and none of the correction signal is supplied to output transducer 14. Other ratios are of course possible by varying gains 308 and 310. In the fully disengaged condition of the power limiter, gain 308 is zero and gain 310 is one, and all of correction signal 46 is supplied to output transducer 14 and none of the correction signal is shunted through path 306.

It is preferred that power limiting be disengaged when a calculated correction signal, theoretically needed for full cancellation, decreases below a disengagement threshold. The theoretically needed correction signal $S_T$ is calculated according to the equation $$S_T = S_C \frac{S_O + S_H}{S_O}$$

where $S_c$ is the correction signal 46 output by model 40, $S_o$ is the part of the correction signal supplied to output transducer 14, and $S_H$ is the part of the correction signal at line 316 shunted through shunt path 306 and gain 308. $S_o$ is decreased and $S_H$ is increased if $S_o$ is greater than a given threshold range. $S_o$ is increased and $S_H$ is decreased if $S_T$ is less than another given threshold range. The two thresholds may be the same, though it is preferred that they are different.

FIG. 3 is like FIG. 2 and uses like reference numerals where appropriate to facilitate understanding. FIG. 3 shows a further embodiment wherein shunt path 318 is provided through existing S'E' model copy 146 and variable gain 320. The use of existing model copy 146 eliminates the need to add model copy 312 in FIG. 2. Model copy 146 and variable gain 320 are in series in shunt path 318 between the output of model 40 and summer 314, with variable gain 320 being downstream of model copy 146.

In further embodiments, input transducer 10 is eliminated, and the input signal is provided by a transducer such as a tachometer which provides the frequency of a periodic input acoustic wave such as from an engine or the like. Further alternatively, the input signal may be provided by one or more error signals, in the case of a periodic noise source, "Active Adaptive Sound Control In A Duct: A Computer Simulation", J. C. Burgess, Journal of Acoustic Society of America, 70(3), Sep. 1981, pp. 715–726. In other applications, directional speakers and/or microphones are used and there is no feedback path modeling. In other applications, a high grade or near ideal speaker is used and the speaker transfer function is unity, whereby model 142 models only the error path. In other applications, the error path transfer function is unity, e.g. by shrinking the error path distance to zero or placing the error microphone 16 immediately adjacent speaker 14, whereby model 142 models only the canceling speaker 14. The invention can also be used for acoustic waves in other fluids, e.g. water, etc., acoustic waves in three dimensional systems, e.g. room interiors, etc., and acoustic waves in solids, e.g. vibrations in beams, etc. The system includes a propagation path or environment such as within or defined by a duct or plant 4, though the environment is not limited thereto and may be a room, a vehicle cab, free space, etc. The system has other applications such as vibration control in structures or machines, wherein the input and error transducers are accelerometers, force sensors, etc., for sensing the respective acoustic waves, body movement, etc., and the output transducers are shakers for outputting canceling acoustic waves, movement, etc. An exemplary application is active engine mounts in an automobile or truck for damping engine vibration The system is also applicable to complex structures for vibration control. In general, the system may be used for attenuation and spectral shaping of an undesired elastic wave in an elastic medium, i.e. an acoustic wave propagating in an acoustic medium, the acoustic wave including sound and/or vibration.

It is recognized that various equivalents, alternatives and modifications are possible within the scope of the appended claims.

We claim:

1. An active acoustic attenuation method for attenuating an input acoustic wave comprising:

introducing a canceling acoustic wave from an output transducer to attenuate said input acoustic wave and yield an attenuated output acoustic wave;

sensing said output acoustic wave with an error transducer and providing an error signal;

providing an adaptive filter model having an error input from the error signal and outputting a correction signal to said output transducer to introduce the canceling acoustic wave;

providing a shunt path around said output transducer;

preventing overdriving of said output transducer by shunting at least part of said correction signal to said shunt path and away from said output transducer.

2. The method according to claim 1 comprising providing said shunt path in parallel with said output transducer and the error path between said output transducer and said error transducer.

3. The method according to claim 2 comprising:

providing a variable gain in at least one of said shunt path and the input to said output transducer varying the ratio between the part of said correction signal supplied to said output transducer and the part of said correction signal shunted to said shunt path.

4. The method according to claim 3 comprising providing a first variable gain in said shunt path, and a second variable gain in the input to said output transducer.

5. The method according to claim 4 wherein the sum of said first and second gains is unity.

6. The method according to claim 2 comprising:

providing an auxiliary noise source and introducing noise therefrom into said model, such that said error transducer also senses the auxiliary noise from said auxiliary noise source;

providing a second adaptive filter model having a model input from said auxiliary noise source and modeling said output transducer and said error path;

providing a copy of said second model;

providing an input to said copy from the output of said first model;

summing the output of said copy with said error signal and supplying the resultant sum to said error input of said first model;

providing said shunt path through said copy.

7. The method according to claim 1 comprising at least partially shunting said correction signal from the input of said output transducer to the output of said error transducer.

8. The method according to claim 7 comprising shunting said correction signal in response to a given characteristic thereof which would cause overdriving of said output transducer.

9. The method according to claim 7 comprising shunting said correction signal in response to a given characteristic of said input acoustic wave which would cause said model to output a correction signal which would cause overdriving of said output transducer.

10. The method according to claim 7 comprising:

determining a theoretically needed correction signal $S_T$ according to the equation $$S_T = S_C \frac{S_O + S_H}{S_O}$$

where $S_c$ is the correction signal output by said model, $S_o$ is the part of said correction signal input to said output transducer, and $S_H$ is the part of said correction signal shunted to said shunt path;

decreasing $S_o$ and increasing $S_H$ if $S_o$ is greater than a given threshold range;

increasing $S_o$ and decreasing $S_H$ if $S_T$ is less than another given threshold range.

11. An active acoustic attenuation method for attenuating an input acoustic wave comprising:

introducing a canceling acoustic wave from an output transducer to attenuate said input acoustic wave and yield an attenuated output acoustic wave;

sensing said output acoustic wave with an error transducer and providing an error signal;

providing a first adaptive filter model having an error input from the error signal and outputting a correction signal to said output transducer to introduce the canceling acoustic wave;

providing a second adaptive filter model modeling said output transducer and the error path between said output transducer and said error transducer;

providing a copy of said second model;

providing an input to said copy from the output of said first model;

summing the output of said copy with said error signal and supplying the resultant sum to said error input of said first model.

12. The method according to claim 11 comprising providing a variable gain in series with said copy between said output of said first model and the output of said error transducer.

13. The method according to claim 12 comprising providing said variable gain upstream of said copy.

14. The method according to claim 12 comprising providing said variable gain downstream of said copy.

15. An active acoustic attenuation system for attenuating an input acoustic wave comprising:

an output transducer introducing a canceling acoustic wave to attenuate said input acoustic wave and yield an attenuated output acoustic wave;

an error transducer sensing said output acoustic wave and providing an error signal;

an adaptive filter model having an error input from the error signal and outputting a correction signal to said output transducer to introduce the canceling acoustic wave;

a shunt path around said output transducer and preventing overdriving of said output transducer by shunting at least part of said correction signal to said shunt path and away from said output transducer.

16. The system according to claim 15 wherein said shunt path is in parallel with said output transducer and the error path between said output transducer and said error transducer.

17. The system according to claim 16 comprising a variable gain in at least one of said shunt path and the input to said output transducer and varying the ratio between the part of said correction signal supplied to said output transducer and the part of said correction signal shunted to said shunt path.

18. The system according to claim 17 comprising a first variable gain in said shunt path, and a second variable gain in the input to said output transducer.

19. The system according to claim 18 wherein the sum of said first and second gains is unity.

20. The system according to claim 16 comprising:

an auxiliary noise source introducing noise into said model, such that said error transducer also senses the auxiliary noise from said auxiliary noise source;

a second adaptive filter model having a model input from said auxiliary noise source and modeling said output transducer and said error path;

a copy of said second model having an input from the output of said first model;

a summer summing the output of said copy with said error signal and supplying the resultant sum to said error input of said first model, wherein said shunt path is through said copy.

21. The system according to claim 15 wherein at least part of said correction signal is shunted from the input of said output transducer to the output of said error transducer.

22. An active acoustic attenuation system for attenuating an input acoustic wave comprising:

an output transducer introducing a canceling acoustic wave to attenuate said input acoustic wave and yield an attenuated output acoustic wave;

an error transducer sensing said output acoustic wave and providing an error signal;

a first adaptive filter model having an error input from the error signal and outputting a correction signal to said output transducer to introduce the canceling acoustic wave;

a second adaptive filter model modeling said output transducer and the error path between said output transducer and said error transducer;

a copy of said second model having an input from the output of said first model;

a summer summing the output of said copy with said error signal and supplying the resultant sum to said error input of said first model.

23. The system according to claim 22 comprising a variable gain in series with said copy between said output of said first model and said summer.

24. The system according to claim 23 wherein said variable gain is upstream of said copy.

25. The system according to claim 23 wherein said variable gain is downstream of said copy.

26. An active acoustic attenuation system for attenuating an input acoustic wave comprising:

an output transducer introducing a canceling acoustic wave to attenuate said input acoustic wave and yield an attenuated output acoustic wave;

an error transducer sensing said output acoustic wave and providing an error signal;

a first adaptive filter model having an error input from the error signal and outputting a correction signal to said output transducer to introduce the canceling acoustic wave, said first adaptive filter model comprising;

a first algorithm filter having a filter input, a filter output, and an error input from said error transducer;

a second algorithm filter having a filter input from said correction signal, a filter output, and an error input from said error transducer; and a first summer having a first input from said filter output of said first algorithm filter, a second input from said filter output of said second algorithm filter, and an output outputting a resultant sum as said correction signal;

a second adaptive filter model modeling said output transducer and the error path between said output transducer and said error transducer;

a first copy of said second model, said first copy having an input from said filter input of said first algorithm filter, and having an output to said error input of said first algorithm filter;

a second copy of said second model, said second copy having an input from said correction signal, and having an output to said error input of said second algorithm filter;

a shunt path around said output transducer and preventing overdriving of said output transducer by shunting at least part of said correction signal to said shunt path and away from said output transducer, said shunt path including said second copy.

27. The system according to claim 26 comprising a second summer summing the output of said copy with said error signal and supplying the resultant sum to said error input of said first model.

28. The system according to claim 27 comprising a variable gain in said shunt path in series with said second copy.

29. The system according to claim 28 wherein said variable gain is downstream of said second copy.

* * * * *